US006573863B2

(12) United States Patent
Vail et al.

(10) Patent No.: US 6,573,863 B2
(45) Date of Patent: Jun. 3, 2003

(54) PHASED ARRAY ANTENNA SYSTEM UTILIZING HIGHLY EFFICIENT PIPELINED PROCESSING AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 33 days.

(21) Appl. No.: 09/990,756

(22) Filed: Nov. 9, 2001

(65) Prior Publication Data

US 2002/0070893 A1 Jun. 13, 2002

Related U.S. Application Data

(60) Provisional application No. 60/255,007, filed on Dec. 12, 2000.

(51) Int. Cl.[7] ..... H01Q 3/24
(52) U.S. Cl. ..... 342/372
(58) Field of Search ..... 342/368, 371, 342/372, 377; 343/700 MS

(56) References Cited

U.S. PATENT DOCUMENTS

| | | | | |
|---|---|---|---|---|
| 4,931,803 A | | 6/1990 | Shimko | 342/371 |
| 4,980,691 A | | 12/1990 | Rigg et al. | 342/372 |
| 4,994,814 A | | 2/1991 | Aoki et al. | 342/372 |
| 4,996,532 A | | 2/1991 | Kirimoto et al. | 342/81 |
| 5,008,680 A | | 4/1991 | Willey et al. | 342/372 |
| 5,027,126 A | | 6/1991 | Basehgi et al. | 342/372 |
| 5,072,228 A | | 12/1991 | Kuwahara | 342/360 |
| 5,225,841 A | | 7/1993 | Krikorian et al. | 342/204 |
| 5,231,405 A | | 7/1993 | Riza | 342/375 |
| 5,243,274 A | | 9/1993 | Kelsey et al. | 324/158 R |
| 5,283,587 A | | 2/1994 | Hirshfield et al. | 342/372 |
| 5,353,031 A | | 10/1994 | Rathi | 342/372 |
| 5,493,255 A | | 2/1996 | Murtojarvi | 330/296 |
| 5,559,519 A | | 9/1996 | Fenner | 342/174 |
| 5,592,179 A | | 1/1997 | Windyka | 342/372 |
| 5,655,841 A | | 8/1997 | Storm | 374/183 |
| 5,680,141 A | | 10/1997 | Didomenico et al. | 342/372 |
| 5,771,016 A | | 6/1998 | Mullins et al. | 342/372 |
| 5,821,901 A | * | 10/1998 | Zagrodnick et al. | 342/368 |
| 5,938,779 A | | 8/1999 | Preston | 714/718 |
| 5,990,830 A | * | 11/1999 | Vail et al. | 342/368 |
| 5,995,740 A | | 11/1999 | Johnson | 395/500.41 |
| 5,999,990 A | | 12/1999 | Sharrit et al. | 718/8 |
| 6,011,512 A | | 1/2000 | Cohen | 342/372 |
| 6,023,742 A | | 2/2000 | Ebeling et al. | 710/107 |
| 6,097,335 A | * | 8/2000 | Cassen et al. | 342/175 |
| 6,157,681 A | | 12/2000 | Daniel et al. | 375/298 |
| 6,163,220 A | | 12/2000 | Schellenberg | 330/295 |
| 6,172,642 B1 | | 1/2001 | DiDomenico et al. | 342/368 |

* cited by examiner

*Primary Examiner*—Gregory C. Issing
(74) *Attorney, Agent, or Firm*—Allen, Dyer, Doppelt, Milbrath & Gilchrist, P.A.

(57) ABSTRACT

A phased array antenna system may include a substrate and a plurality of phased array antenna elements carried by the substrate, a plurality of antenna element controllers connected to the phased array antenna elements, and at least one higher level controller connected to the plurality of antenna element controllers. The at least one higher level controller and/or lower level antenna element controllers in some embodiments may perform a processing operation on a first portion of a received multi-bit command message before receiving all bits of the multi-bit command message.

39 Claims, 4 Drawing Sheets

PHASED ARRAY ANTENNA SYSTEM UTILIZING HIGHLY EFFICIENT PIPELINED PROCESSING AND RELATED METHODS

RELATED APPLICATION

This application is based upon prior filed copending provisional application Serial No. 60/255,007 filed Dec. 12, 2000, the entire subject matter of which is incorporated herein by reference in its entirety.

FIELD OF THE INVENTION

The present invention relates to the field of communications, and, more particularly, to phased array antenna systems and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antenna systems, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping") or direction (i.e., "beam steering") of the communications signals in response to the signal environment to improve performance characteristics.

Several attempts have been made in the prior art to reduce the overall rate at which beam commands (e.g., beam steering commands) are processed and to reduce beam latency times). For example, one particularly useful approach is disclosed in U.S. Pat. No. 5,990,830 to Vail et al. entitled "Serial Pipelined Phase Weight Generator for Phased Array Antenna Having Subarray Controller Delay Equalization," which is assigned to the present assignee. The patent discloses a "just in time" pipelined signal processing architecture for a phased array antenna. Signal propagation paths between a pipelined communications link-through subarray control processors distributed along the pipeline link-and phase control elements of the antenna have different serial pipelined transport delays. These delays are such that all of the phase control signals, after being fully processed by the subarray control processors, are applied simultaneously to their associated subsets of antenna phase control elements. As a result, wiring complexity is reduced and beam steering updates are provided more rapidly.

Another more general prior art approach to improving processing time is disclosed in U.S. Pat. No. 6,023,742 to Ebeling et al. entitled "Reconfigurable Computing Architecture for Providing Pipelined Data Paths." This patent discloses an architecture which includes a reconfigurable data path. The data path has a plurality of elements including functional units, registers, and memories whose interconnection and functionality is determined by a combination of static control (i.e., configuration) and dynamic control (i.e., instructions). These elements are connected together, using the static configuration, into a pipelined data path that performs a computation of interest. The dynamic control signals are used to change the operation of a functional unit and the routing of signals between functional units. The static control signals are each provided by a static memory cell that is written to by a host.

While the pipelining functionality of such an architecture may provide certain advantages in some applications, it may not be well suited for application in a phased array antenna system where different types of processing may occur in different controllers (e.g., in a central controller, subarray controllers, and antenna element controllers). That is, while such prior art methods may provide some improved processing time as a result of pipelining within a given processor or level of processors, significant delays may still result when downstream processors remain idle waiting for upstream processors to provide the appropriate beam steering/shaping commands and data.

SUMMARY OF THE INVENTION

In view of the foregoing background, it is therefore an object of the present invention to provide a phased array antenna system which provides more efficient usage of processor time and may therefore reduce beam steering latency time and increase beam steering update rates.

This and other objects, features, and advantages in accordance with the present invention are provided by a phased array antenna system which may include a substrate and a plurality of phased array antenna elements carried by the substrate, a plurality of antenna element controllers connected to the phased array antenna elements, and at least one higher level controller connected to the plurality of antenna element controllers. The at least one higher level controller may perform a processing operation on a first portion of a received multi-bit command message before receiving all bits of the multi-bit command message.

More particularly, the at least one higher level controller may transmit downstream results of the processing operation before receiving all bits of the multi-bit command message. The at least one higher level controller may include a plurality of subarray controllers, and each subarray controller may be connected to a respective group of antenna element controllers. Additionally, the phased array antenna system may also include a first serial communications network connecting the subarray controllers to the antenna element controllers.

Furthermore, the at least one higher level controller may further include a central controller connected to the plurality of subarray controllers, and a second serial communications network may connect the central controller to the subarray controllers. Additionally, the phased array antenna system may also include a host connected to the central controller. The multi-bit command message may relate to beam steering, and the processing operation may include a serial multiplication, for example. Also, the first portion of the at least one multi-bit command message may include at least one least significant bit thereof.

A method aspect of the invention is for operating a phased array antenna system such as that described above. The method may include using the at least one higher level controller for performing a processing operation on a first portion of a received multi-bit command message before receiving all bits of the multi-bit command message.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
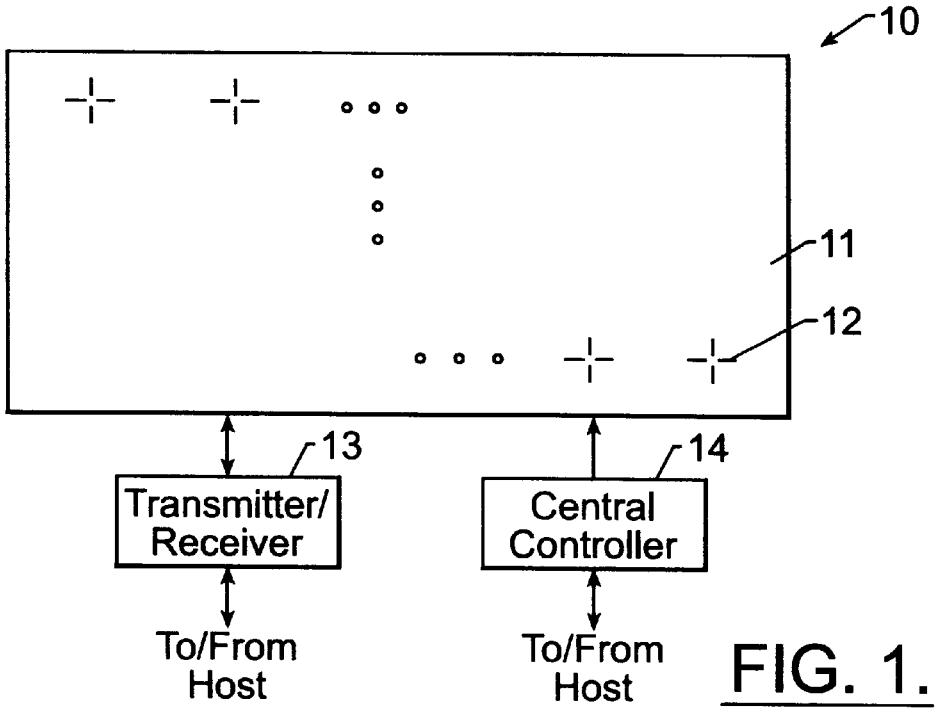
FIG. 1 is schematic block diagram of a phased array antenna system according to the present invention.

Referring initially to FIG. 1, a phased array antenna system 10 according to the invention includes a substrate 11 and a plurality of phased array antenna elements 12 carried thereby. As used herein, "substrate" refers to any surface, mechanized structure, etc., which is suitable for carrying a phased array antenna element, as will be appreciated by those of skill in the art. The phased array antenna system 10 may also include a transmitter/receiver 13 for sending and receiving communications signals (e.g., microwave or RF signals) via the antenna elements 12, and a central controller 14, which will be described further below.

The transmitter/receiver 13 and central controller 14 may also be connected to a host 15, for processing the signals to be transmitted or received and for providing beam steering/shaping data to the central controller, for example. The phased array antenna system 10 may be used for ground, airborne, or spaceborne applications, as will be readily understood by those skilled in the art.

Figure 2:
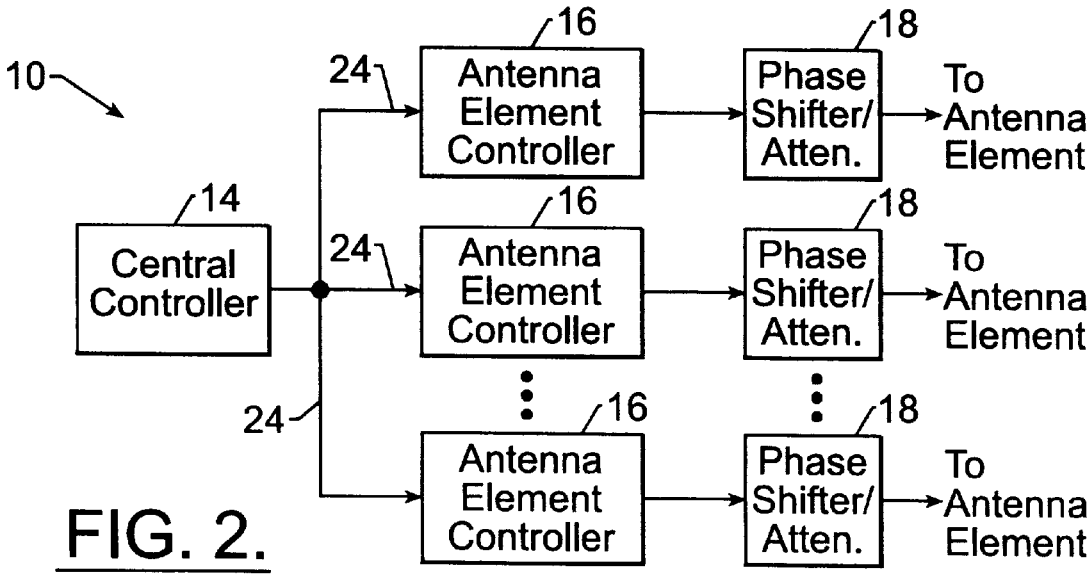
FIG. 2 is a schematic block diagram of a central controller and subgroup of antenna element controllers of the phased array antenna system of FIG. 1.

Turning now to FIG. 2, the phased array antenna system 10 illustratively includes a respective antenna element controller 16 connected to each of the phased array antenna elements 12 via a respective phase shifter and/or attenuator 17, for example. Of course, in some embodiments a single antenna element controller 16 may control more than one phased array antenna element 12, as will be appreciated by those of skill in the art. Each phase shifter/attenuator 17 is used to implement a specific beam steering or shaping command for its respective antenna element 12, as will be appreciated by those of skill in the art.

Furthermore, the phased array antenna system 10 may include at least one higher level controller, such as the central controller 14, for example, connected to the antenna element controllers 16. In other words, the central controller 14 is a higher level or upstream controller with respect to the antenna elements controller 16. As shown in FIG. 2, the central controller 14 is connected to a subgroup 19 of three antenna element controllers 16 via a serial communications network 20, for example. Of course, more or less antenna element controllers 16 may be included in the subgroup 19. Further, parallel communications links may be used in some embodiments instead of the serial communications networks 20', 21*a*'–21*n*' noted above. Yet, parallel communications links may increase wiring complexity.

According to the present invention, the at least one higher level controller (i.e., the central controller 14) may perform a processing operation on a first portion of a received multi-bit command message before receiving all bits of the multi-bit command message. More particularly, the central controller 14 may transmit downstream results of the processing operation before receiving all bits of the multi-bit command message. This "micro-pipelined" processing operation will be described further with reference to FIG. 4, below.

In certain embodiments, two (or more) higher levels of controllers may be included. For example, in the alternate embodiment illustrated in FIG. 3 two higher levels of controllers are included. That is, one of the higher processor levels includes a plurality of subarray controllers 18*a*'–18*n*', and the other higher processor level includes the central controller 14'. As similarly described with respect to FIG. 2, a serial communications network 20' may connect the central controller 14' to the subarray controllers 18*a*'–18*n*'. Further, each subarray controller 18*a*'–18*n*' may be connected to a respective subgroup 19*a*'–19*n*' of antenna element controllers 16' via serial communications networks 21*a*'–21*n*'.

The micro-pipelined processing operating performed by the various controllers of the present invention will now be described more fully with reference to FIG. 4. At a time $t_0$, a multi-bit central controller command message 30 is transmitted by the host 15' to the central controller 14'. For example, this multi-bit central controller command message 30 may relate to beam steering or shaping and include instructions that require changing phase and/or attenuation values of the phased array antenna elements 12. More particularly, the multi-bit central controller command message 30 may include phase gradients (e.g., in two coordinate axes), frequency, temperature, and/or spoiling coefficient data, as will be understood by those of skill in the art.

A first portion 31 of the multi-bit central controller command message 30 is transmitted between the time $t_0$ and a time $t_A$. As noted above, the central controller 14' may perform a processing operation on the first portion 31 of the received multi-bit central controller command message 30 before receiving all bits of the multi-bit central controller command message.

By way of example, the first portion 31 of the multi-bit central controller command message 30 may include at least one least significant bit thereof. The central controller 14 may therefore begin performing certain processing operations on the first portion 31 which initially require only the least significant bit. For example, such processing operations may include a serial multiplication, as illustratively shown by multiplication blocks 22' in the central controller 14' of FIG. 3. Such processing operations may be required for scaling a phase gradient for a new operating frequency in a frequency-hopping phased array design, for example Of course, other processing operations may also be performed.

As a result, the central controller 14' may advantageously transmit downstream to the subarray controllers 18*a*'–18*n*' results (i.e., multi-bit subarray command messages) 32 of the processing operation before receiving all of the bits of the multi-bit central command message 30. The subarray controllers 18*a*'–18*n*' may similarly perform processing operations on a first portion 33 (which extends between the time $t_A$ and a time $t_B$) of received multi-bit subarray command messages 32 before receiving all of the bits thereof. Here again, the multi-bit subarray command messages 32 may include x and y phase gradients, operating frequency, spoiling coefficient data, and/or temperature compensation index data, for example.

Thus, the subarray controllers 18*a*'–18*n*' may begin transmitting multi-bit element command messages 34 downstream to the antenna element controllers 16 before receiving all of the bits of the multi-bit subarray control messages 32. The subarray controllers 18$a'$–18$n'$ may also transmit element data 35 along with the element commands 34, as will be appreciated by those of skill in the art. Of course, a single higher level of pipeline processing may be used instead of both the subarray controllers 18$a'$–18$n'$ and the central controller 14, if desired.

Figure 5A:
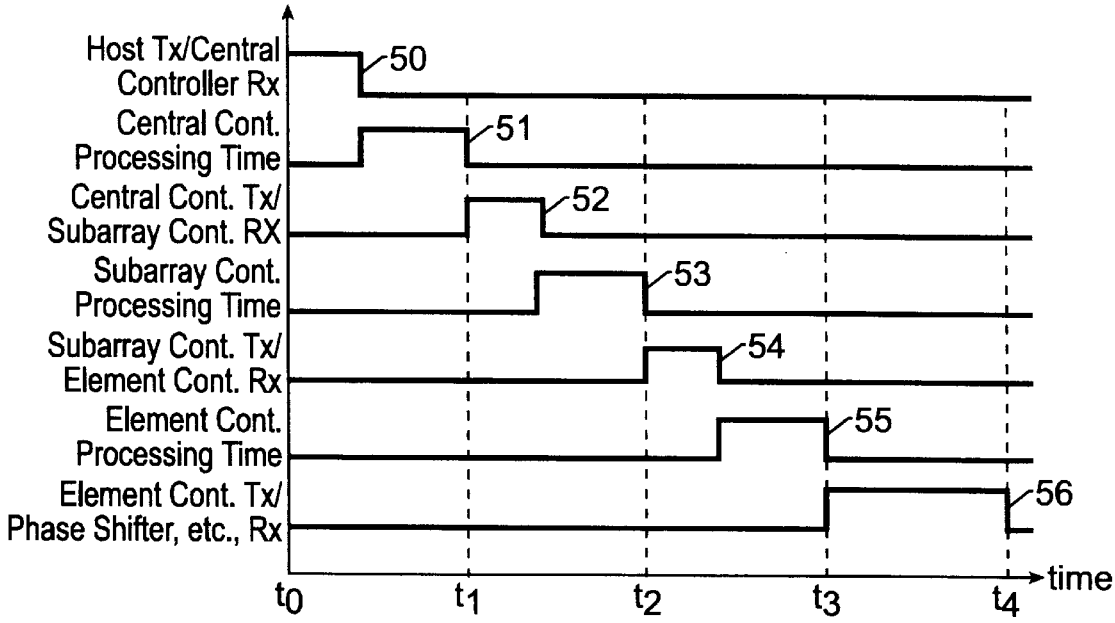
FIG. 5A. (PRIOR ART)
FIGS. 5A and 5B are more detailed timing diagrams respectively illustrating pipelined processing according to the prior art and according to the present invention.
Figure 5B:
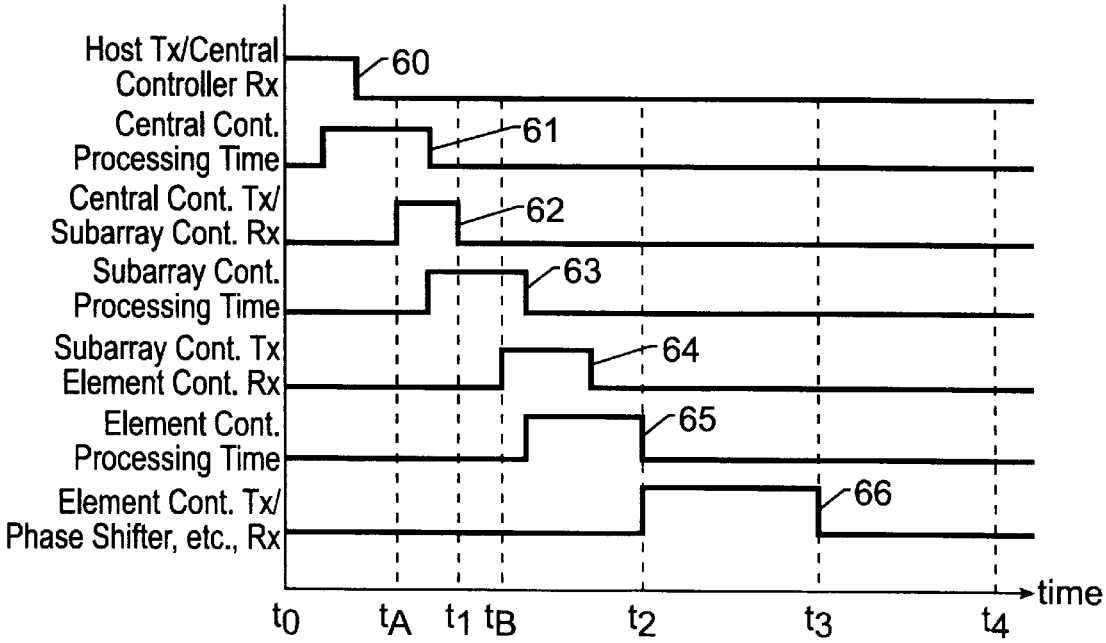

The above micro-pipelining operations and advantages thereof will be further understood with reference to the timing diagrams of FIGS. 5A and 5B, which respectively illustrate pipelined beam command processing according to the prior art and according to the present invention. For purposes of the illustration, it will be assumed that the beam commands being processed are beam steering commands, though other commands (e.g., beam spoiling commands, frequency hopping commands, etc.) may similarly be processed, as will be understood by those of skill in the art.

Referring initially to FIG. 5A, at a time $t_0$ the host 15 sends a beam steering command to the central controller 14, which has a transmission/reception time 50 associated therewith, as will be appreciated by those skilled in the art. The central processor 14 then processes the beam steering command for a time 50, at which point it sends respective commands/data (e.g., x and y phase gradients) to the subarray controllers 18$a'$–18$n'$. As illustratively shown, a transmission/reception time 52 is associated with this operation. The subarray controllers 18$a'$–18$n'$ then process their respective commands/data, which requires a time 53.

Similarly, a time 54 is required to transmit respective commands/data (e.g., uncompensated phase values) from the subarray controllers 18$a'$–18$n'$ and to receive the commands/data at the antenna element controllers 16'. The antenna element controllers 16' then process the commands/data for a time 55 (e.g., to compute temperature-compensated phase values) and provide respective control signals to the phase shifters 17' for one beam update time 56. It may be seen that according to this prior art approach the beam steering processing only begins in a given controller after the entire beam steering commands/data are received from the immediate upstream controller. As a result, for this example a latency of three beam update periods is required from the time the host 15 sends the beam steering command until the antenna element controllers 16' actually begin to implement the command. That is, the first beam update period extends from $t_0$ to $t_1$, the second beam update period extends from $t_1$ to $t_2$, and the third beam update period extends from $t_2$ to $t_3$.

Turning now to FIG. 5B, the micro-pipelined processing approach according to the present invention includes transmission/reception and processing times 60–62 similar to the times 50–52 illustrated in FIG. 5A. Yet, it may be seen that the delay caused by the central controller 14' processing time 51 (FIG. 5A) is substantially avoided since the central controller begins processing the commands/data from the host 15 before they are completely received (i.e., time 61). This is also the case with the subarray controllers 18$a'$–18$n'$ (i.e. the time 63) and antenna element controllers 16' (i.e., time 65). Accordingly, the latency for the example illustrated in FIG. 5B according to the present invention is two beam update periods i.e., from $t_0$ to $t_2$ where the time 66 for transmitting/receiving the phase shifter control signals begins. The result for this example is a one beam update period savings over the above described prior art approach of FIG. 5A.

A method aspect of the invention is for operating the phased array antenna system 10' described above. The method may include using the at least one higher level controller (e.g., the central controller 14' and/or subarray controllers 18$a'$–19$a'$) for performing a processing operation on a first portion of a received multi-bit command message before receiving all bits of the multi-bit command message. The remaining aspects of the method may be as previously described above.

It will be appreciated that the above described pipeline processing of the present invention provides significant advantages over prior art phased array antenna system architectures. For example, slower communication links may be used for connecting the various controllers because of the improved data transfer, which may reduce both costs and power consumption. Additionally beam steering latency delays may be minimized by minimizing the need for additional beam steering command pipeline stages, as will be appreciated by those skilled in the art.

Furthermore, the above noted controllers may include one or more application specific integrated circuits (ASICs) for performing the various processing tasks. These ASICs may therefore be made to operate at slower speeds, (and requiring correspondingly lower power) and may also minimize logic complexity since for some calculations only a single bit at a time need be calculated and stored. Thus, such ASICs may not only be less expensive, but may also have enhanced reliability.

EXAMPLES

Figure 3:
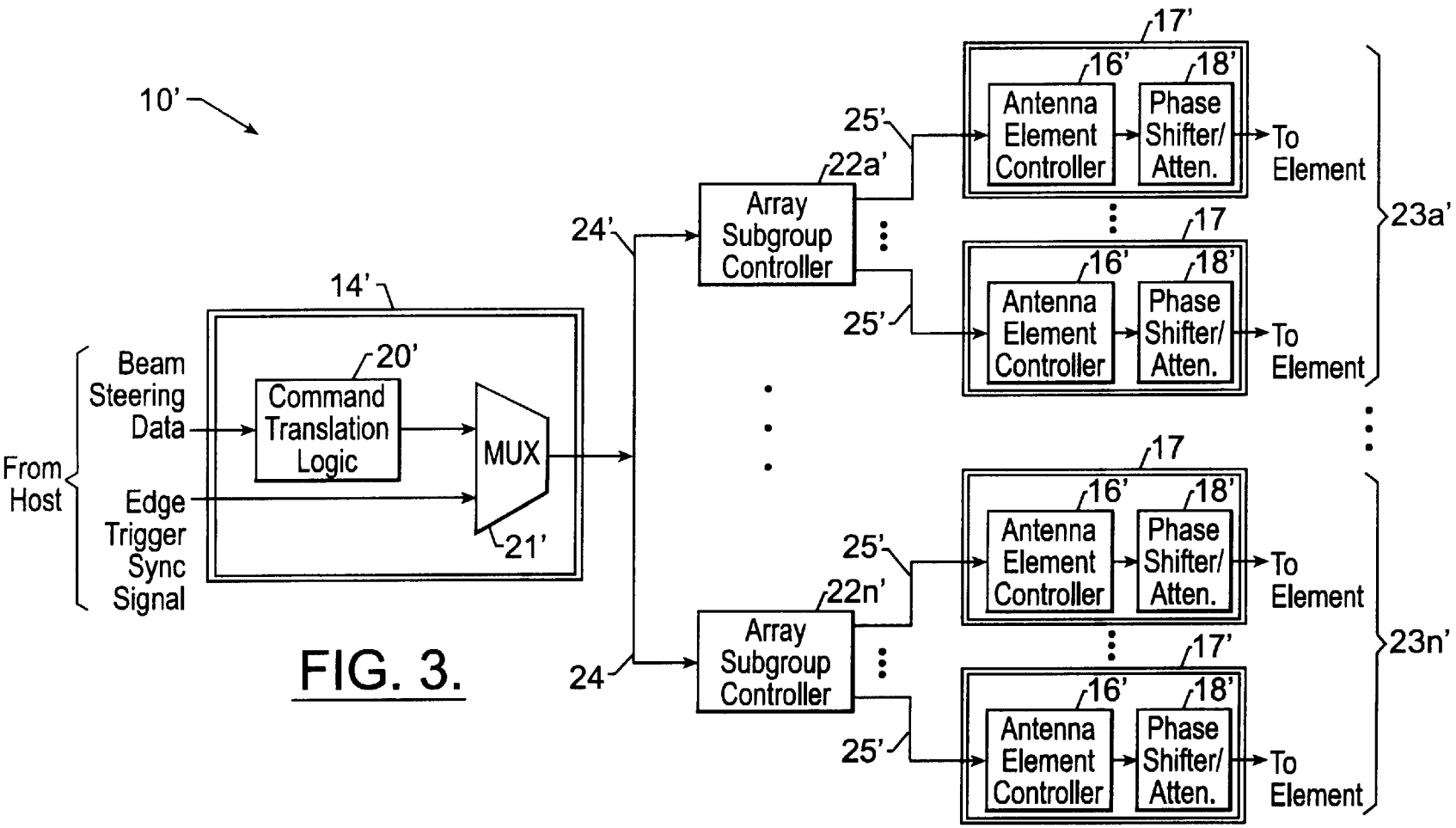
FIG. 3 is a schematic block diagram of an alternate embodiment of the phased array antenna system of FIG. 1.
Figure 4:
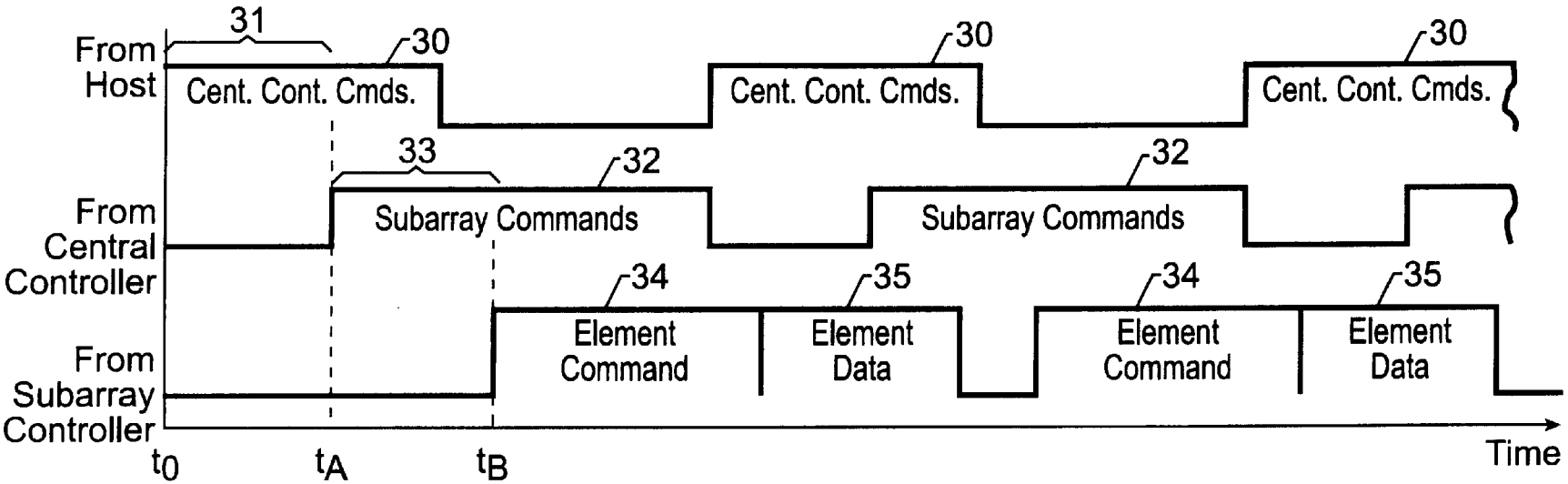
FIG. 4 is a timing diagram illustrating pipelined processing according to the present invention.

By way of example, the above architecture and pipelined processing illustrated in FIGS. 3 and 4 were implemented in a phased array antenna system which used 7.5 Megabit/second serial communications links to form the serial communications networks 20' and 21$a'$–21$n'$. The phased array antenna system was designed to provide beam hopping in 50 $\mu$s intervals, as will be understood by those of skill in the art. Using the above described pipeline processing according to the present invention, all of the requisite commands and data updates for implementing a next beam steering position were typically processed within about 44.3 $\mu$s, leaving a 5.7 $\mu$s timing margin. The system was implemented with an overall command latency time of approximately 60 $\mu$s, i.e., a beamsteer command is used one beamsteer interval after it is received by the central controller 14.

To achieve similar processing throughput using a typical prior art configuration in which each controller substantially performs all of its processing before transmitting commands to the downstream processor(s), the data transfer speeds of the serial communications networks thereof would need to be significantly faster. Thus, it will be understood by those of skill in the art that the present invention may provide the same or better throughput as in prior art architectures that may be more costly, consume more power, and be less reliable.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna system comprising:

a substrate and a plurality of phased array antenna elements carried by said substrate;

a plurality of antenna element controllers connected to said phased array antenna elements; and at least one higher level controller connected to said plurality of antenna element controllers for performing a processing operation on a first portion of a received multi-bit command message before receiving all bits of the multi-bit command message.

2. The phased array antenna system according to claim 1 wherein the at least one higher level controller further transmits downstream results of the processing operation before receiving all bits of the multi-bit command message.

3. The phased array antenna system according to claim 1 wherein said at least one higher level controller comprises a plurality of subarray controllers, each subarray controller being connected to a respective group of antenna element controllers.

4. The phased array antenna system according to claim 3 further comprising a first serial communications network connecting said subarray controllers to said antenna element controllers.

5. The phased array antenna system according to claim 3 wherein said at least one higher level controller further comprises a central controller connected to said plurality of subarray controllers.

6. The phased array antenna system according to claim 5 further comprising a second serial communications network connecting said central controller to said subarray controllers.

7. The phased array antenna system according to claim 5 further comprising a host connected to said central controller.

8. The phased array antenna system according to claim 1 wherein the multi-bit command message relates to beam steering.

9. The phased array antenna system according to claim 1 wherein the processing operation comprises a serial multiplication.

10. The phased array antenna system according to claim 1 wherein the first portion of the at least one multi-bit command message comprises at least one least significant bit thereof.

11. A phased array antenna system comprising:

a substrate and a plurality of phased array antenna elements carried by said substrate;

a respective antenna element controller connected to each of said phased array antenna elements; and at least one higher level controller connected to said plurality of antenna element controllers for performing a processing operation on a first portion of a received multi-bit command message and transmitting results thereof downstream before receiving all bits of the multi-bit command message;

said at least one higher level controller comprising a plurality of subarray controllers each connected to a respective group of antenna element controllers, and a central controller connected to said plurality of subarray controllers.

12. The phased array antenna system according to claim 11 further comprising a first serial communications network connecting said subarray controllers to said antenna element controllers.

13. The phased array antenna system according to claim 12 further comprising a second serial communications network connecting said central controller to said subarray controllers.

14. The phased array antenna system according to claim 11 further comprising a host connected to said central controller.

15. The phased array antenna system according to claim 11 wherein the multi-bit command message relates to beam steering.

16. The phased array antenna system according to claim 11 wherein the processing operation comprises a serial multiplication.

17. The phased array antenna system according to claim 11 wherein the first portion of the at least one multi-bit command message comprises at least one least significant bit thereof.

18. A phased array antenna system comprising:

a substrate and a plurality of phased array antenna elements carried by said substrate;

a respective antenna element controller connected to each of said phased array antenna elements; and at least one higher level controller connected to said plurality of antenna element controllers for performing a processing operation on a first portion of a received multi-bit command message relating to antenna beam steering and transmitting results thereof downstream before receiving all bits of the multi-bit command message.

19. The phased array antenna system according to claim 18 wherein said at least one higher level controller comprises a plurality of subarray controllers, each subarray controller being connected to a respective group of antenna element controllers.

20. The phased array antenna system according to claim 19 further comprising a first serial communications network connecting said subarray controllers to said antenna element controllers.

21. The phased array antenna system according to claim 19 wherein said at least one higher level controller further comprises a central controller connected to said plurality of subarray controllers.

22. The phased array antenna system according to claim 21 further comprising a second serial communications network connecting said central controller to said subarray controllers.

23. The phased array antenna system according to claim 21 further comprising a host connected to said central controller.

24. The phased array antenna system according to claim 18 wherein the processing operation comprises a serial multiplication.

25. The phased array antenna system according to claim 18 wherein the first portion of the at least one multi-bit command message comprises at least one least significant bit thereof.

26. A phased array antenna system comprising:

a substrate and a plurality of phased array antenna elements carried by said substrate;

a respective antenna element controller connected to each of said phased array antenna elements; and at least one higher level controller connected to said plurality of antenna element controllers for performing a serial multiplication operation on a first portion of a received multi-bit command message and transmitting results thereof downstream before receiving all bits of the multi-bit command message.

27. The phased array antenna system according to claim 26 wherein said at least one higher level controller comprises a plurality of subarray controllers, each subarray controller being connected to a respective group of antenna element controllers.

28. The phased array antenna system according to claim 27 further comprising a first serial communications network connecting said subarray controllers to said antenna element controllers.

29. The phased array antenna system according to claim 27 wherein said at least one higher level controller further comprises a central controller connected to said plurality of subarray controllers.

30. The phased array antenna system according to claim 29 further comprising a second serial communications network connecting said central controller to said subarray controllers.

31. The phased array antenna system according to claim 29 further comprising a host connected to said central controller.

32. The phased array antenna system according to claim 26 wherein the multi-bit command message relates to beam steering.

33. The phased array antenna system according to claim 26 wherein the first portion of the at least one multi-bit command message comprises at least one least significant bit thereof.

34. A method for operating a phased array antenna system of a type comprising a substrate and a plurality of phased array antenna elements carried by the substrate, a plurality of antenna element controllers connected to the phased array antenna elements, and at least one higher level controller connected to the antenna element controllers, the method comprising:

using the at least one higher level controller for performing a processing operation on a first portion of a received multi-bit command message before receiving all bits of the multi-bit command message.

35. The method according to claim 34 further comprising using the at least one higher level controller to transmit downstream results of the processing operation before receiving all bits of the multi-bit command message.

36. The method according to claim 34 wherein the at least one higher level controller comprises a plurality of subarray controllers each being connected to a respective group of antenna element controllers, and a central controller connected to the subarray controllers.

37. The method according to claim 34 wherein the multi-bit command message relates to beam steering.

38. The method according to claim 34 wherein the processing operation comprises a serial multiplication.

39. The method according to claim 34 wherein the first portion of the at least one multi-bit command message comprises at least one least significant bit thereof.

* * * * *